US008937252B2

(12) United States Patent
Mayer-Rosa et al.

(10) Patent No.: US 8,937,252 B2
(45) Date of Patent: Jan. 20, 2015

(54) COATED ELECTRIC CABLE FOR USE IN A WELDING DEVICE

(71) Applicant: Balluff GmbH, Neuhausen a.d.F. (DE)

(72) Inventors: Michael Mayer-Rosa, Neuhausen a.d.F. (DE); Thomas Bayer, Neuhausen a.d.F. (DE); Andreas Kammerer, Winnenden (DE)

(73) Assignee: Balluff GmbH, Neuhausen a.d.F. (DE)

( * ) Notice: Subject to any disclaimer, the term of this patent is extended or adjusted under 35 U.S.C. 154(b) by 0 days.

(21) Appl. No.: 14/048,127

(22) Filed: Oct. 8, 2013

(65) Prior Publication Data

US 2014/0291019 A1 Oct. 2, 2014

(30) Foreign Application Priority Data

Mar. 27, 2013 (DE) ..... 20 2013 002 911 U

(51) Int. Cl.
*H01B 7/29* (2006.01)
*H01B 7/295* (2006.01)

(52) U.S. Cl.
CPC . *H01B 7/29* (2013.01); *H01B 7/295* (2013.01)
USPC ..... 174/74 R; 174/110 R; 174/113 R

(58) Field of Classification Search
CPC ..... H01B 7/295; H01B 3/18; H01B 3/46; H01R 11/26
USPC ... 174/74 R, 75 R, 102 R, 103, 105 R, 113 R, 174/110 R
See application file for complete search history.

(56) References Cited

U.S. PATENT DOCUMENTS

| | | | | |
|---|---|---|---|---|
| 3,823,255 | A * | 7/1974 | La Gase et al. | 174/113 R |
| 4,150,249 | A * | 4/1979 | Pedersen | 174/36 |
| 4,547,626 | A * | 10/1985 | Pedersen et al. | 174/107 |
| 4,659,871 | A * | 4/1987 | Smith et al. | 174/113 R |
| 7,211,766 | B2 * | 5/2007 | Rehrig | 219/137.9 |
| 7,247,797 | B2 * | 7/2007 | Buthe et al. | 174/110 R |
| 7,378,595 | B2 * | 5/2008 | Brambilla | 174/113 R |
| 7,511,245 | B2 * | 3/2009 | Hsu | 219/98 |

(Continued)

OTHER PUBLICATIONS

IEC 60332-2-2, Tests on electric and optical fibre cables under fire conditions—Part 2-2: Test for vertical flame propagation for a single small insulated wire or cable—Procedure for diffusion flame, First Edition, Jul. 2004, total of 36 pages.

(Continued)

*Primary Examiner* — Hoa C Nguyen
*Assistant Examiner* — Amol Patel
(74) *Attorney, Agent, or Firm* — Collard & Roe, P.C.

(57) ABSTRACT

An electric cable includes at least one power line having first and second ends, including multiple cores. Each core has a core insulation. All core insulations are enclosed by a common sheath surrounded by an oversheath that includes a material selected from silicones, perfluorocarbons, mica, glass fibers, metal fibers, ceramic fibers, and mixtures thereof. A first plug connector is arranged on the power line first end. At least one second plug connector is arranged on the power line second end. Each plug connector is completely coated with the oversheath and includes a flame retardant containing polyurethane. A first connecting nut is arranged on the first plug connector At least one second connecting nut is arranged on a second plug connector. Each connecting nut includes a perfluorocarbon. The electric cable has high resistance to welding use conditions and may be used as a control line for a welding device.

12 Claims, 2 Drawing Sheets

(56) References Cited

U.S. PATENT DOCUMENTS

| | | | | |
|---|---|---|---|---|
| 2007/0087637 | A1* | 4/2007 | Zart et al. | 439/736 |
| 2009/0056974 | A1* | 3/2009 | Groegl et al. | 174/113 R |
| 2013/0206463 | A1* | 8/2013 | Boday et al. | 174/258 |

OTHER PUBLICATIONS

DIN ISO 7619-1, Rubber, vulcanized or thermoplastic—Determination of indentation hardness—Part 1: Durometer method (Shore hardness) (ISO 7619-1:2010), Feb. 2012, total of 17 pages.
DIN EN 7619-2, Rubber, vulcanized or thermoplastic—Determination of indentation hardness—Part 2: IRHD pocket meter method (ISO 7619-2:2010), Feb. 2012, total of 10 pages.
ISO 868, Plastics and ebonite—Determination of indentation hardness by means of a durometer (Shore hardness), Mar. 1, 2003, total of 12 pages.
English translation of DIN 53504, Testing of rubber—Determination of tensile strength at break, tensile stress at yield, elongation at break and stress values in a tensile test, Oct. 2009, total of 18 pages.
DIN ISO 34-1, Rubber, vulcanized or thermoplastic—Determination of tear strength, Part 1: Trouser, angle and crescent test pieces, Jul. 2004, total of 14 pages. (and also DIN ISO 34-1, Jul. 2005, Correction to DIN ISO 34-1:2004-07, 2 pages).
English translation of DIN ISO 4649, Rubber, vulcanized or thermoplastic—Determination of abrasion resistance using a rotating cylindrical drum device, Nov. 2006, total of 20 pages.
English translation of DIN EN ISO 179-1, Plastics—Determination of Charpy impact properties—Part 1: Non-instrumented impact test, Nov. 2010, total of 29 pages.
English translation of DIN EN 13602, Copper and copper alloys—Drawn, round copper wire for the manufacture of electrical conductors, Sep. 2013, total of 24 pages.
CEI IEC 60529, Degrees of protection provided by enclosures (IP Code), Edition 2.1, Feb. 2001, total of 102 pages, with Correction 1 dated Jan. 2003 and Correction 2 dated Oct. 2007.
ISO 7619-1, Rubber, vulcanized or thermoplastic—Determination of indentation hardness—Part 1: Durometer method (Shore hardness), Second edition, Oct. 1, 2010, total of 20 pages.

* cited by examiner

COATED ELECTRIC CABLE FOR USE IN A WELDING DEVICE

CROSS REFERENCE TO RELATED APPLICATIONS

Applicant claims priority under 35 U.S.C. §119 of German Application No. 20 2013 002 911.0 filed Mar. 27, 2013, the disclosure of which is incorporated by reference.

BACKGROUND OF THE INVENTION

1. Field of the Invention

The present invention relates to an electric cable. Furthermore, the invention relates to the use of the electric cable as a control line for a welding device.

2. Prior Art

Welding devices, in particular welding robots for automated industrial applications, require for their control electric cables which can withstand high stresses. It is required that such electric cables are to be flame resistant according to different standards such as IEC 60332-2, VDE 0482-265-2-2, and EN 50265-2-2. In addition, they must be able to withstand the contact with welding beads, i.e., the metal which melts and sprays during the welding, over a long period of time.

Currently known electric cables, which are used in welding devices, must be regularly replaced, since cable cores are exposed very often due to the rough conditions during welding. It is therefore the object of the present invention to provide an electric cable that has a particularly high resistance with respect to welding conditions and which can be used as a control line for a welding device.

SUMMARY OF THE INVENTION

This object is achieved by the electric cable according to the invention. It comprises at least one power line having a first end and a second end, comprising multiple cores, wherein each core has a core insulation and all core insulations are enclosed by a common sheath, and the sheath is surrounded by an oversheath, wherein the oversheath comprises a material which is selected from the group consisting of silicones, perfluorocarbons, mica, glass fibers, metal fibers, ceramic fibers, and mixtures thereof, a first plug connector, which is arranged on the first end of the power line, and at least one second plug connector, which is arranged on the second end of the power line, wherein the plug connectors each are completely coated with the oversheath and comprise a polyurethane (PU), which contains a flame retardant, and a first connecting nut, which is arranged on the first plug connector, and at least one second connecting nut, which is arranged on a second plug connector, wherein the connecting nuts each comprise a perfluorocarbon. The combination of materials according to the invention results in an extraordinarily high resistance of the electric cable with respect to the conditions of welding use. Therefore, it is suitable in particular for use as a control line for a welding device.

The power line comprises at least two cores and preferably four cores. It can thus be connected as a polar-rectified cable, in which the magnetic fields of the four cores partially compensate for one another. The cores each consist in particular of Cu-ETP1 according to DIN EN 13602.

The core insulations preferably comprise a material, which is selected from the group consisting of polyalkylenes, polyvinyl chloride and mixtures thereof. The sheath preferably comprises a material, which is selected from the group consisting of polyurethane, polyvinyl chloride, thermoplastic polyester elastomers, thermoplastic copolyesters and mixtures thereof. Particularly preferred are the following combinations of core insulation material and sheath material: core insulation and sheath of polyvinyl chloride; core insulation of polyvinyl chloride and sheath of thermoplastic polyester elastomers; core insulation of polypropylene and sheath of polyurethane.

The complete coating of the sheath by the oversheath seals the transition between the conductor and the plug connectors especially such, that the electric cable of the invention complies with the protective class IP67 according to the norm DIN EN 60529.

Perfluorocarbons are understood according to the invention in particular as perfluoroalkanes, perfluorocoalkylenes, perfluoroalkoxypolymers, and copolymers of methacrylates and perfluoroalkyacrylates. Polytetrafluoroethylene (PTFE), perfluoroethylenepropylene (FEP), and mixtures thereof are preferred.

The glass fibers preferably consist of E-glass yarn (CAS-number 65997-17-3).

The metal fibers are preferably nickel fibers.

The oversheath can optionally be saturated with a silicone.

The plug connectors preferably comprise a polyurethane which is based on a polyester, a polyether, or a polyester ether as a polyol. Among these, a polyether is particularly preferred. The flame retardant in the material of the plug connector is in particular a halogen-free flame retardant. Furthermore, it is preferable for the plug connectors to each consist of a material which has a hardness of at least Shore 54D according to the standards DIN 53505 and ISO 868. The tensile strength of the material is preferably at least 28 MPa according to DIN 53504. Its ultimate elongation is preferably at least 380% according to DIN 53504. Its tear resistance is preferably at least 100 N/mm according to DIN ISO 34-1Bb. Its abrasion is preferably at most 25 $mm^3$ according to DIN ISO 4649-A. Its notched impact strength (Charpy) at +23° C. is preferably at least 45 $kJ/m^2$ according to DIN EN ISO 179.

BRIEF DESCRIPTION OF THE DRAWINGS

Exemplary embodiments of the invention are illustrated in the drawings and explained in greater detail in the following description.

EXEMPLARY EMBODIMENTS OF THE INVENTION

Figure 1:
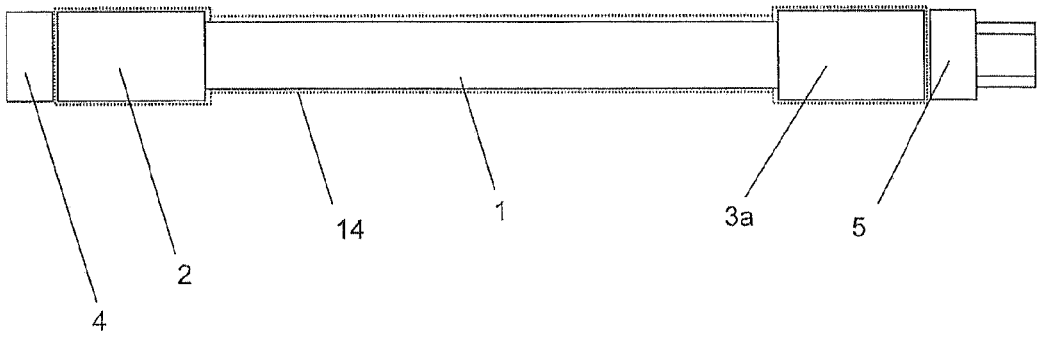
FIG. 1 shows a side view of an electric cable according to one embodiment of the invention.
Figure 2:
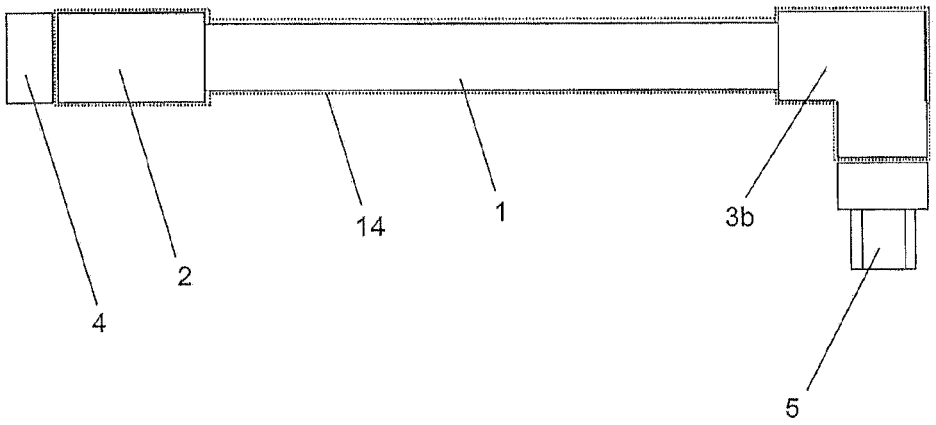
FIG. 2 shows a side view of an electric cable according to another embodiment of the invention.
Figure 3:
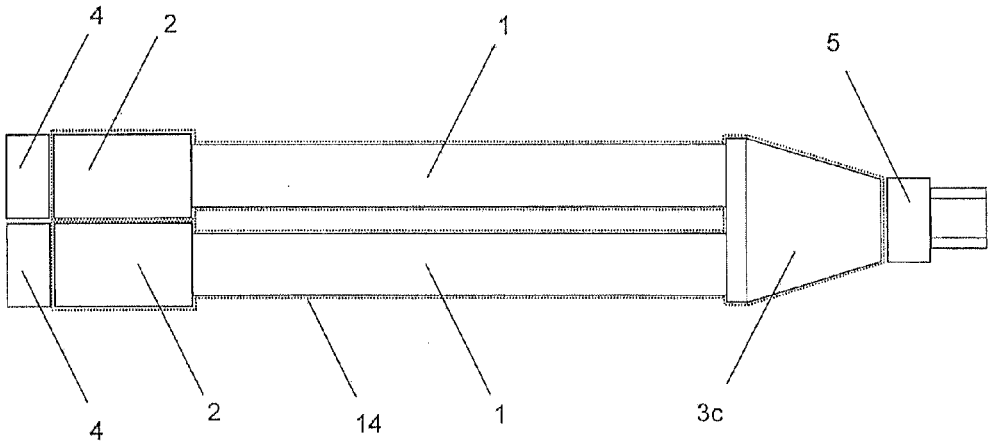
FIG. 3 shows a side view of an electric cable according to still another embodiment of the invention.
Figure 4:
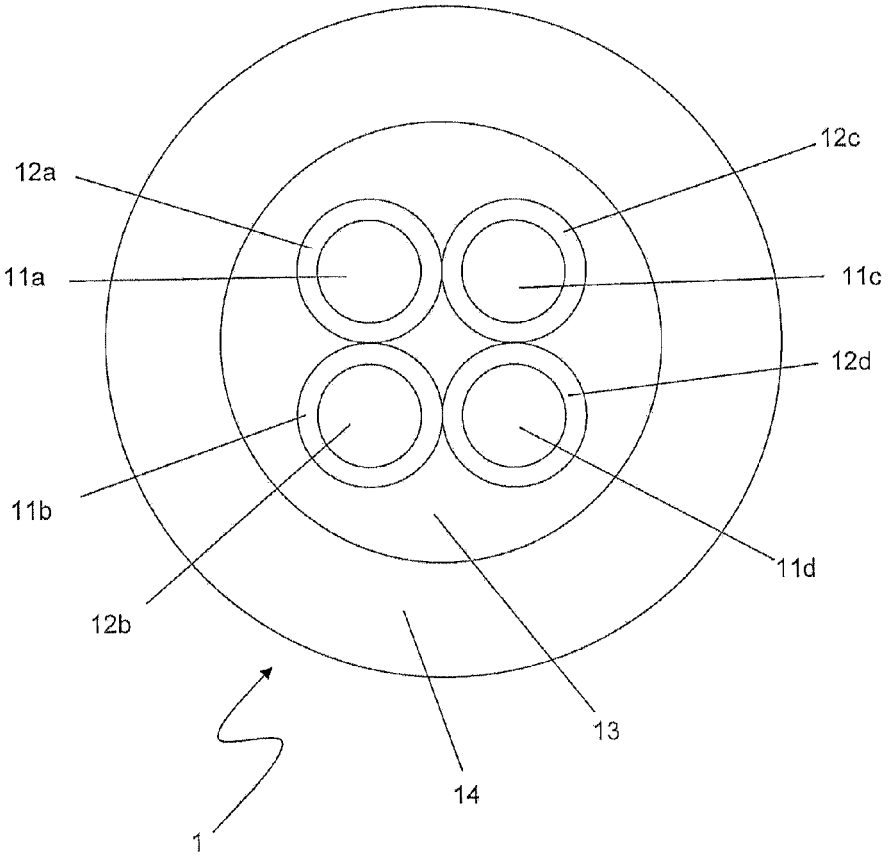
FIG. 4 shows a longitudinal section through the power line of an electric cable according to one embodiment of the invention.

The resistance of cables with respect to welding conditions was studied in comparative examples (VB1 to VB7) and examples according to the invention (B1 and B2) of electric cables. The construction of such an electric cable is shown in three embodiments in FIGS. 1, 2, and 3. FIG. 4 shows a longitudinal section through the power line 1 of this electric cable. The power line 1 comprises four cores 11*a*, 11*b*, 11*c*, 11*d*. Each core 11*a*, 11*b*, 11*c*, 11*d* has a core insulation 12*a*, 12*b*, 12*c*, 12*d*. All core insulations 12*a*, 12*b*, 12*c*, 12*d* are enclosed by a common sheath 13. The sheath is completely coated with the oversheath 14. A first plug connector 2 is arranged at the first end of the power line 1. A second plug connector 3*a*, 3*b*, 3*c* is arranged at the second end of the power line. The second plug connector can be embodied as a linear plug connector 3*a*, as an angled plug connector 3*b*, or as a Y-plug connector 3*c*. The plug connectors 2, 3*a*, 3*b*, 3*c* are each crimped onto the power line 1. A first connecting nut 4 is arranged on the first plug connector 2. A second connecting nut 5 is arranged on the second plug connector 3*a*, 3*b*, 3*c*.

The cores 11*a*, 11*b*, 11*c*, 11*d* consisted in all examples of Cu-ETP1 and had a cross-sectional area of 0.34 $mm^2$ each. The materials M12 of the core insulations 12*a*, 12*b*, 12*c*, 12*d*, the materials M13 of the sheaths 13, the materials M14 of the oversheaths, the materials M2/3 of the plug connectors 2, 3*a*, 3*b*, 3*c*, and the materials M4/5 of the connecting nuts 4, 5 are listed in Table 1:

TABLE 1

| # | M12 | M13 | M14 | M2/3 | M4/5 | Resistant |
|---|---|---|---|---|---|---|
| VB1 | PVC | PVC | PTFE* | PU + flame retardant | PTFE | No |
| VB2 | PVC | PVC | glass* | PU + flame retardant | PTFE | No |
| VB3 | PVC | PVC | aramid* | PU + flame retardant | PTFE | No |
| VB4 | PVC | PVC | PET* | PU + flame retardant | PTFE | No |
| VB5 | PVC | PVC | silicone | PVC | PTFE | No |
| VB6 | PVC | PVC | silicone | PU + flame retardant | steel | No |
| B1 | PVC | PVC | PTFE | PU + flame retardant | PTFE | Yes |
| B2 | PVC | TPE-E | PTFE | PU + flame retardant | PTFE | Yes |
| B3 | PP | PU | PTFE | PU + flame retardant | PTFE | Yes |
| B4 | PP | PU | silicone | PU + flame retardant | PTFE | Yes |
| B5 | PP | PU | glass# | PU + flame retardant | PTFE | Yes |
| B6 | PP | PU | metal | PU + flame retardant | PTFE | Yes |

Therein, PVC stands for polyvinylchloride, PP for polypropylene, PTFE for polytetrafluoroethylene, PU for polyurethane, TPE-E for a thermoplastic polyester elastomer, glass for E-glass fiber yarn, aramid for para-aramid and metal for metal fibers All materials M14 being marked with a * were pushed as hose over the sheath 13 (VB1-VB4). In the example, in which the material M14 is marked with a #, the sheath 13 was weaved with the oversheath 14 and the plug connectors 2, 3*a*, 3*b*, 3*c* were completely coated with the material M14 of the oversheath 14 (B5). In all examples, in which the materials M14 are not marked with a * or a #, the oversheath 14 was pushed as a hose over the sheath 13 and the plug connectors 2, 3*a*, 3*b*, 3*c* were completely coated with the particular material M14 of the oversheath 14 (VB6-VB7, B1-B4 and B6)

PVC Y17 (hardness Shore 90-95 A) was used as a PVC for the core insulation. PVC YM3 (hardness Shore AB0-B5) was used as a PVC for the sheath. PP9Y (hardness Shore 54D) was used as a polypropylene. TPU 11YH1 (hardness Shore 54D) was used as a polyurethane for the sheath.

All combinations of the core 11*a*, 11*b*, 11*c*, 11*d*, core insulation 12*a*, 12*b*, 12*c*, 12*d* and sheath 13 were provided as complete power lines by the Franz Binder GmbH+Co. Elektrische Bauelemente KG, Neckarsulm, Germany. WIGAFLEX SV 13 of the Garnisch GmbH, Memmingen, Germany was used as an E-glass fiber yarn. Kevlar® of the company E.I. du Pont de Nemours, Wilmington, USA was used as para-aramid. A metal hose UA 2 was used as metal fibers. Elastollan 11 54 D FHF (hardness Shore 58D, tensile strength 30 MPa, elongation at tear 400%, tear resistance 110 N/mm, abrasion 30 $mm^3$, notched impact strength (Charpy) 50 $kJ/m^2$ at +23° C.) from BASF, Ludwigshafen, Germany was used as a polyurethane+flame retardant for the plug connectors 2, 3*a*, 3*b*.

All studied cables were used as a control line in a welding device known per se in 62,200 successive welding cycles. Only the electric cables according to the invention of the examples B1 and B2 withstood these experimental conditions without at least one of the cores being exposed. Therefore, these have a particularly high resistance with respect to welding conditions.

What is claimed is:

1. An electric cable, comprising at least one power line (1) having a first end and a second end, comprising multiple cores (11*a*, 11*b*, 11*c*, 11*d*), wherein each core (11*a*, 11*b*, 11*c*, 11*d*) has a core insulation (12*a*, 12*b*, 12*c*, 12*d*), all core insulations are enclosed by a common sheath (13), and the sheath is enclosed by an oversheath, wherein the oversheath (14) comprises a material which is selected from the group consisting of silicones, perfluorocarbons, mica, glass fibers, metal fibers, ceramic fibers, and mixtures thereof, a first plug connector (2), which is arranged on the first end of the power line (1), and at least one second plug connector (3*a*, 3*b*), which is arranged on the second end of the power line, wherein the plug connectors (2, 3*a*, 3*b*) each are completely coated with the oversheath (14) and comprise a polyurethane that contains a flame retardant, and a first connecting nut (4), which is arranged on the first plug connector (2), and at least one second connecting nut (5), which is arranged on the second plug connector (3*a*, 3*b*), wherein the connecting nuts each comprise a fluorocarbon.

2. The electric cable according to claim 1, wherein the oversheath comprises perfluorocarbons selected from the group consisting of polytetrafluoroethylene, perfluoroethylenepropylene, and mixtures thereof.

3. The electric cable according to claim 1, wherein the oversheath comprises E-glass yarn.

4. The electric cable according to claim 1, wherein the oversheath comprises nickel fibers.

5. The electric cable according to claim 1, wherein the polyurethane is based on a polyester, a polyether, or a polyester ether.

6. The electric cable according to claim 1, wherein the flame retardant is a halogen-free flame retardant.

7. The electric cable according to claim 1, wherein that the plug connectors (2, 3*a*, 3*b*) each comprise a material which has a hardness of at least Shore 54D.

8. The electric cable according to claim 1, wherein the power line (1) comprises four cores (11*a*, 11*b*, 11*c*, 11*d*).

9. The electric cable according to claim 1, wherein cores (11*a*, 11*b*, 11*c*, 11*d*) each comprise Cu-ETP1.

10. The electric cable according to claim 1, wherein the core insulations (12*a*, 12*b*, 12*c*, 12*d*) comprise a material which is selected from the group consisting of polyalkylenes, polyvinyl chloride and mixtures thereof.

11. The electric cable according to claim 1, wherein the sheath (13) comprises a material which is selected from the group consisting of polyurethane, polyvinyl chloride, thermoplastic polyester elastomers, thermoplastic copolyesters and mixtures thereof.

12. A method of use of an electric cable according to claim 1 as a control line for a welding device.

* * * * *